United States Patent [19]

Delgado

[11] 4,299,390

[45] Nov. 10, 1981

[54] ELECTION BOARD GAME WITH CAMPAIGN PROMISE MARKERS

[75] Inventor: Raul J. Delgado, Hipólito Unánue N° 1515 - Lince, Lima, Perú

[73] Assignee: Raul Delgado, Lima, Perú

[21] Appl. No.: 84,744

[22] Filed: Oct. 15, 1979

[51] Int. Cl.[3] ..... A63F 3/00; A63F 3/04

[52] U.S. Cl. ..... 273/257

[58] Field of Search ..... 273/257, 279, 256

[56] References Cited

U.S. PATENT DOCUMENTS

| | | | |
|---|---|---|---|
| 678,824 | 7/1901 | Carney | 273/279 |
| 2,043,482 | 6/1936 | Lord | 273/257 |
| 3,545,762 | 12/1970 | Atkinson | 273/257 |
| 4,118,036 | 10/1978 | Marse | 273/257 |

*Primary Examiner*—Richard C. Pinkham
*Assistant Examiner*—Scott L. Brown
*Attorney, Agent, or Firm*—Lewis H. Eslinger

[57] ABSTRACT

A political game is disclosed which includes a game board having a plurality of playing spaces providing a play path for the players. The spaces include a first group which correspond to political subdivisions and a second group which provide play instructions. Each player selects a distinctive play piece for movement along the spaces in accordance with the number displayed on a random chance selection device such as a pair of dice. A plurality of distinctive campaign promise markers, respectively representing different types of political promises are adapted to be selected by the players and placed in political subdivision spaces upon which they land. A campaign promise scoring value chart is provided including indicia assigning a maximum and minimum percentage of the vote value for each campaign promise in a particular political subdivision. The player accumulating the largest percentage of the vote in a particular political subdivision wins it. And the player winning the greatest number of political subdivisions, or the electoral votes assigned to them, within a given time period is the winner of the game.

14 Claims, 5 Drawing Figures

FIG. 2

SCORING VALUE OF CAMPAIGN PROMISES 38 40 36 34

| | | TOTAL VOTE | AGRICULTURE | FARMS & CATTLE | MANUFACTURING. INDUST. | MINING & METALS | ENERGY | PETROLEUM & GAS | EDUCATION | HEALTH & WELFARE | ENVIRONMENT | TRANSPORTATION | TOURISM |
|---|---|---|---|---|---|---|---|---|---|---|---|---|---|
| YELLOW ZONE : WEST | | | | | | | | | | | | | |
| 1 | WASH. - OREG. | 16 | 35 - 20 | --- | 40 - 25 | 25 - 15 | --- | --- | 20 - 10 | --- | --- | --- | 30 - 20 |
| 2 | NEVA. - CALI. | 49 | 30 - 20 | 20 - 10 | 25 - 15 | 25 - 15 | --- | 20 - 10 | --- | --- | --- | --- | 30 - 20 |
| 3 | MONT. - IDAH. | 8 | 40 - 25 | --- | 35 - 20 | 30 - 20 | --- | 20 - 10 | --- | --- | --- | --- | 25 - 15 |
| 4 | WYOM. - UTAH | 8 | 20 - 10 | --- | 35 - 20 | 40 - 25 | --- | 30 - 20 | --- | --- | --- | --- | 25 - 15 |
| 5 | NEBR. - COLO. | 12 | 35 - 20 | 25 15 | 35 - 20 | 30 - 20 | --- | --- | --- | --- | --- | 25 - 15 | --- |
| 6 | ARIZ. - N.MEX. | 11 | 25 - 15 | 25 15 | 30 - 20 | 40 - 25 | --- | 30 - 20 | --- | --- | --- | --- | --- |
| BLUE ZONE : MIDWEST | | | | | | | | | | | | | |
| 1 | N. DAK. - S. DAK. | 6 | 40 - 25 | --- | 25 - 15 | 35 - 20 | 25 - 15 | 25 - 15 | --- | --- | --- | --- | --- |
| 2 | MINN. - WISC. | 21 | 30 - 20 | 30 - 20 | 35 - 20 | 30 - 20 | --- | --- | --- | --- | 25 - 15 | --- | --- |
| 3 | MICH. - INDI. | 38 | --- | 25 - 15 | 40 - 25 | 30 - 20 | --- | --- | --- | --- | 30 - 20 | --- | 25 - 15 |
| 4 | IOWA - ILLI. | 33 | 35 - 20 | 20 | 40 - 25 | --- | --- | --- | 25 - 15 | --- | --- | 20 - 10 | --- |
| 5 | KANS. - MISSO. | 19 | 35 - 20 | 35 - 15 | 40 - 25 | --- | --- | 25 - 15 | --- | --- | --- | 25 - 15 | --- |
| 6 | OKLA. - TEX. | 36 | 25 - 15 | 35 - 20 | 25 - 15 | 25 - 15 | --- | 40 - 25 | --- | --- | --- | --- | --- |
| PINK ZONE : NORTHEAST | | | | | | | | | | | | | |
| 1 | MAIN. - N.HAMP. | 8 | --- | 25 - 15 | 40 - 25 | --- | --- | --- | 30 - 20 | 25 - 15 | --- | --- | 30 - 20 |
| 2 | VERM. - MASS. | 16 | --- | 25 - 15 | 40 - 25 | --- | 20 - 10 | --- | 30 - 20 | --- | --- | --- | 35 - 20 |
| 3 | CONE. - RH IS. | 12 | --- | 25 - 15 | 35 - 20 | --- | --- | --- | 25 - 15 | 20 - 10 | --- | 25 - 15 | 20 - 10 |
| 4 | N.YORK - N.JERS. | 55 | --- | 20 - 10 | 40 - 25 | --- | 20 - 10 | --- | --- | 20 - 10 | 15 - 10 | 35 - 20 | --- |
| 5 | OHIO - PENN. | 49 | --- | 20 - 30 | 35 - 20 | 25 - 15 | 15 - 10 | --- | --- | 20 - 10 | 25 - 15 | --- | --- |
| 6 | MARY. DEL. D.C. | 16 | --- | --- | 40 - 25 | --- | --- | --- | 30 - 20 | 30 - 20 | --- | 30 - 20 | 20 - 10 |
| 7 | KENT. - W. VIRG. | 15 | 25 - 15 | 30 - 20 | --- | 40 - 25 | --- | --- | 20 - 10 | --- | --- | 35 - 20 | --- |
| GREEN ZONE : SOUTH, ALASKA, HAWAII | | | | | | | | | | | | | |
| 1 | TENN. - VIRG. | 23 | 30 - 20 | 30 - 20 | 40 - 25 | --- | 25 - 15 | --- | --- | --- | --- | 25 - 15 | --- |
| 2 | N.CAR. - S. CAR. | 21 | 35 - 20 | 35 - 20 | 40 - 25 | --- | --- | --- | --- | --- | --- | 20 - 10 | 20 - 10 |
| 3 | ARKA. - LOUS. | 16 | 30 - 20 | --- | 25 - 15 | --- | 25 - 15 | 30 - 20 | --- | 20 - 10 | --- | --- | 20 - 10 |
| 4 | MISS. - ALAB. | 16 | 40 - 25 | 30 - 20 | 35 - 20 | --- | 25 - 15 | --- | --- | 20 - 10 | --- | --- | --- |
| 5 | GEOR. - FLOR. | 31 | 30 - 20 | --- | 30 - 20 | --- | --- | --- | 25 - 20 | 20 - 10 | --- | 25 - 15 | 20 - 10 |
| 6 | ALAS. - HAWAII | 7 | --- | --- | 30 - 20 | --- | --- | 25 - 15 | 35 - 20 | --- | --- | 40 - 25 | 20 - 10 |

FIG. 3

SCOREBOARD

40

| | | AGRICUL-TURE | FARMS & CATTLE | MANUFACTURING IND. | MINING & METALS | ENERGY | PETROLEUM & GAS | EDUCATION | HEALTH & WELFARE | ENVIRO-MENT | TRANSPOR-TATION | TOURISM | WINNER | TOTAL VOTE |
|---|---|---|---|---|---|---|---|---|---|---|---|---|---|---|
| | | | | YELLOW ZONE : WEST | | | | | | | | | | |
| 1 | WASH. - OREG. | | 50 | | | | | | | | | | | 16 |
| 2 | NEVA. - CALI. | R-1/20 | P-6/10 | P-2/25 | P-4/15 | | T-3/10 | | | | | R-5/20 | P | 49 |
| 3 | MONT. - IDAHO | | | | | | | | | | | | | 8 |
| 4 | WYOM. - UTAH | | | | | | | | | | | | | 8 |
| 5 | NEBR. - COLO. | | | | | | | | | | | | | 12 |
| 6 | ARIZ. - N. MEX. | | | | | | | | | | | | | 11 |
| | | | | BLUE ZONE : MIDWEST | | | | | | | | | | |
| 1 | N. DAK. - S. DAK. | | | | | | | | | | | | | 6 |
| 2 | MINN. - WISC. | | | | | | | | | | | | | 21 |
| 3 | MICH. - INDI. | | | | | | | | | | | | | 11 |
| 4 | IOWA - ILLI. | | | | | | | | | | | | | 33 |
| 5 | KANS. - MISSO. | | | | | | | | | | | | | 19 |
| 6 | OKLA. - TEXAS | | | | | | | | | | | | | 36 |
| | | | | PINK ZONE : NORTHEAST | | | | | | | | | | |
| 1 | MAINE - N. HAMP | | | | | | | | | | | | | 8 |
| 2 | VERM. - MASS. | | | | | | | | | | | | | 16 |
| 3 | CONE. - RH. IS. | | | | | | | | | | | | | 12 |
| 4 | N. YORK - N. JERS. | | | | | | | | | | | | | 55 |
| 5 | OHIO - PENN. | | | | | | | | | | | | | 49 |
| 6 | MARY. - DEL. D.C. | | | | | | | | | | | | | 16 |
| 7 | KENT. - W. VIRG. | | | | | | | | | | | | | 15 |
| | | | | GREEN ZONE : SOUTH, ALASKA, HAWAII | | | | | | | | | | |
| 1 | TENN. - VIRG. | | | | | | | | | | | | | 23 |
| 2 | N. CAR. - S. CAR. | | | | | | | | | | | | | 21 |
| 3 | ARKA. - LOUS. | | | | | | | | | | | | | 16 |
| 4 | MISS. - ALAB. | | | | | | | | | | | | | 16 |
| 5 | GEORG. - FLOR. | | | | | | | | | | | | | 31 |
| 6 | ALAS. - HAWAII | | | | | | | | | | | | | 7 |

FIG. 4

DISTRIBUTION OF CAMPAIGN PROMISES

| NUMBER OF PLAYERS | AGRICULTURE | FARMS & CATTLE | MANUFACTURING INDUSTRIES | MINING & METALS | ENERGY | PETROLEUM & GAS | EDUCATION | HEALTH & WELFARE | ENVIRONMENT | TRANSPORTATION | TOURISM |
|---|---|---|---|---|---|---|---|---|---|---|---|
| 2 | 5 | 5 | 7 | 4 | 2 | 4 | 3 | 2 | 2 | 4 | 4 |
| 3 | 4 | 4 | 5 | 4 | 2 | 3 | 3 | 1 | 1 | 3 | 3 |
| 4 | 3 | 3 | 4 | 3 | 1 | 2 | 2 | 1 | 1 | 3 | 3 |
| 5 | 3 | 3 | 3 | 2 | 1 | 2 | 2 | 1 | 1 | 2 | 2 |
| 6 | 2 | 2 | 3 | 2 | 1 | 1 | 1 | 1 | 1 | 2 | 2 |

32

SELECTION OF COLORS

| NUMBER OF PLAYERS | COLORS |
|---|---|
| 2 | RED AND YELLOW |
| 3 | RED, YELLOW AND GREEN |
| 4 | RED, YELLOW, GREEN AND BLUE |
| 5 | RED, YELLOW, GREEN, BLUE AND ORANGE |
| 6 | RED, YELLOW, GREEN, BLUE, ORANGE & WHITE |

FIG. 5

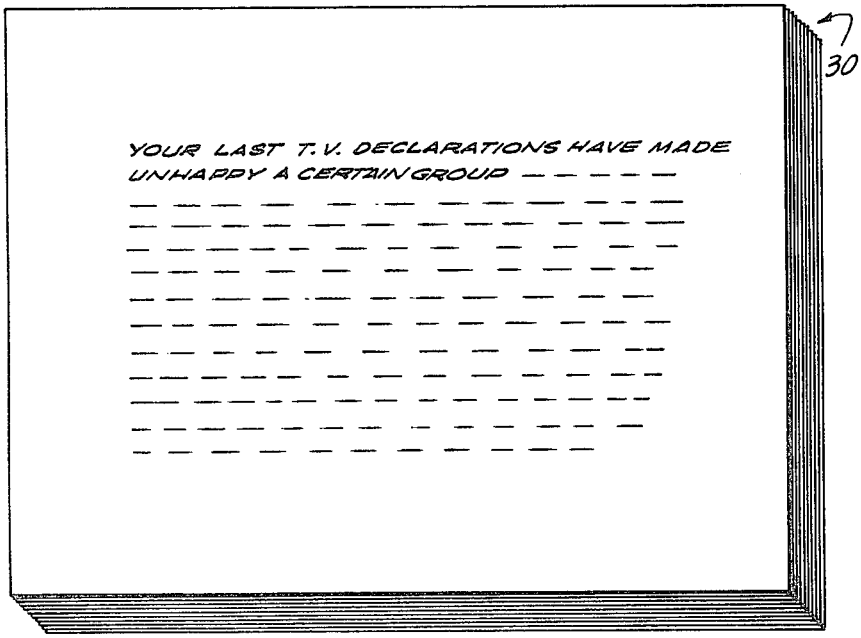

ELECTION BOARD GAME WITH CAMPAIGN PROMISE MARKERS

The present invention relates to games and more particularly to a political campaign game in which the players strive to achieve a particular elective office. Board games used to simulate election campaigns have been previously proposed in a variety of different styles, configurations, and rules. Many of such games are directed towards simulating the conditions which affect the election of the President of the United States. Such games include, for example, those shown in the following U.S. Pat. Nos. 3,545,762; 4,118,036; 4,092,028; 3,907,299; 3,318,601; 2,930,621; 1,714,546; 690,273; 476,146; 391,715; 2,043,482; 2,181,793.

Such games all contain some distinctive feature in rules to distinguish one from the other. However, such games are almost entirely subject to chance, and do not enable the players to make changes in their position in the course of the game as a true political player might during the course of a political election. The first mentioned patent permits some variation in that the players select, apparently at the beginning of the game, a political platform upon which they will run. This, however, fixes their position with respect to various political issues during the course of the game.

It is an object of the present invention to provide a political game which simulates the election of the President of the United States.

Another object of the present invention is to provide a game apparatus which simulates a political election.

A further object of the present invention is to provide a political game apparatus in which the players can selectively make campaign promises in various political subdivisions.

A still further object of the present invention is to provide a political campaign game wherein the players can attain a specific percentage of the vote in a particular political subdivision by making a specific campaign promise, and can reduce the percentage of another player's vote in a particular subdivision by making his own campaign promise.

In accordance with an aspect of the present invention a political campaign game particularly adapted for use in simulating the occurrences of a presidential election campaign in the United States, includes a political game board having a plurality of sides defining a play surface. Indicia are printed on the play surface defining first and second groups of spaces along the sides of the board and providing a play path for the players. The first group of spaces contain indicia indicative of distinct political subdivisions, such as individual states or groups of states, and the second group of spaces contain game affecting instructions. One of the spaces in the second group provides a starting space from which player commences.

A plurality of distinctive play pieces to be selected and used by each of the players are provided and moved along the spaces in the play path in accordance with the number produced on a chance selection device, such as a pair of dice.

A plurality of campaign promise markers are provided including individual sets of markers, one set for each player. The campaign markers in each set include a plurality of subsets of markers, with each of the subsets bearing indicia representative of a different campaign promise to develop particular industry or field.

According to the rules of the game, a varying number of campaign promises of each catagory is available to the players, depending upon the number of players in the game.

A campaign promise scoring value chart is provided including a plurality of columns respectively representing the various campaign promises, and a plurality of rows extending transversely of the columns respectively representing the political subdivisions. The intersection of the columns and rows on the chart define spaces containing maximum and minimum percentages of the vote values for at least some of the campaign promises in each of the political subdivisions. A scoreboard for recording the arrival of a player's play piece at one of the political subdivision spaces and the percentage of vote gained by each player for each of the campaign promises made is also provided.

The above, and other objects, features and advantages of this invention will be apparent in the following detailed description of an illustrative embodiment thereof, which is to be read in connection with the accompanying drawings, wherein:

FIG. 2 is a plan view of the scoring value chart of the game;

FIG. 3 is a plan view of the scoreboard of the game;

FIG. 4 is a plan view of a chart showing the distribution of campaign promises in the game;

FIG. 5 is a plan view of a stack of "criticism and endorsement" cards used in the play of the game.

Figure 1:
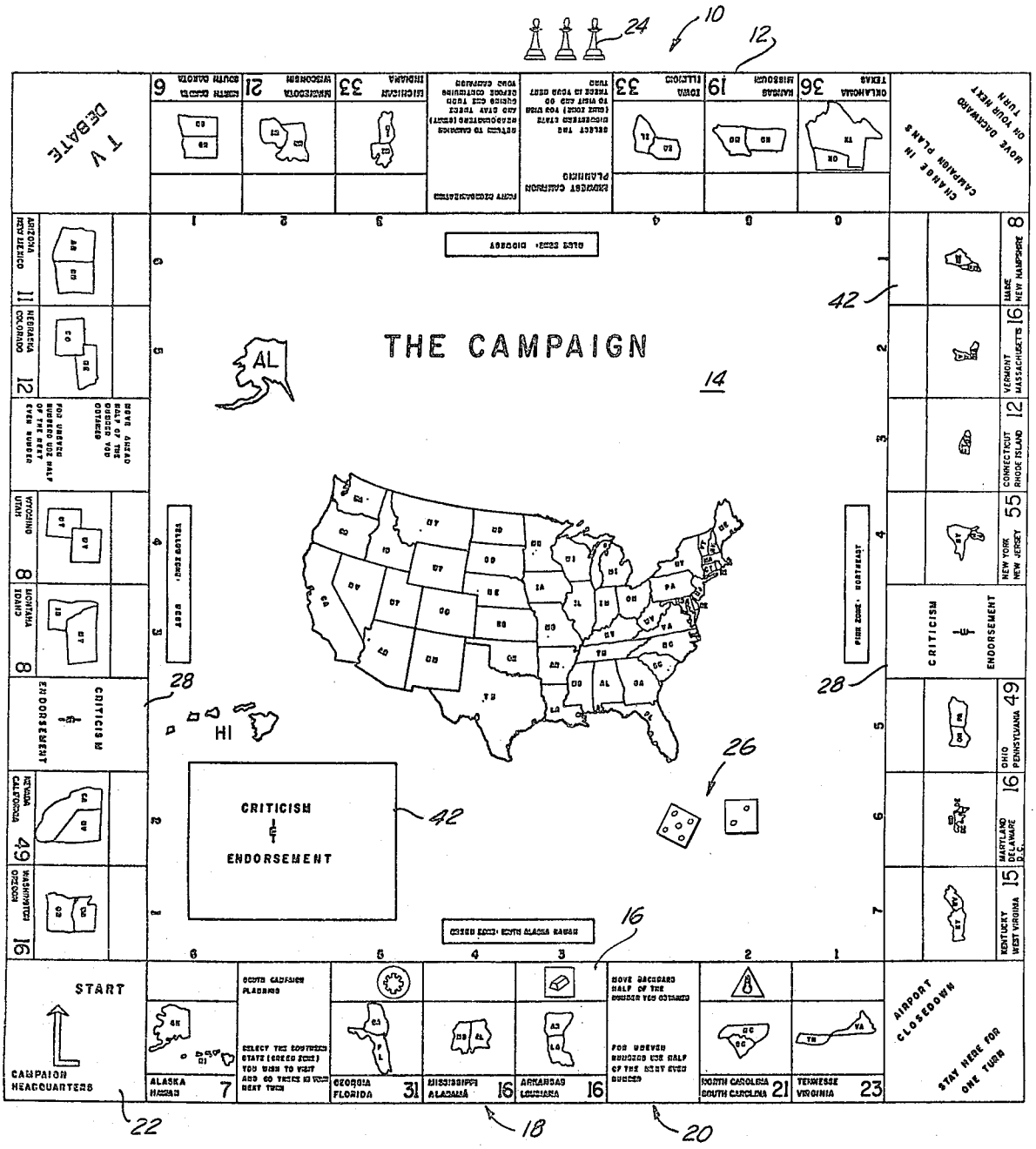
FIG. 1 is a plan view of the game board of the present invention.

Referring now to the drawings in detail, and initially to FIG. 1, the game 10 includes a foldable four-sided game board 12 made of any suitable material and having a play surface 14 thereon.

The play surface is provided with a central map of the United States and the periphery of the play surface is divided by printed indicia or lines into a plurality of rectangular spaces 16. The spaces 16 are, in turn, divided into first and second groups of spaces, with the first group 18 containing 25 spaces, six on three sides of the board and seven on the fourth, printed to represent various political subdivisions in the United States. In accordance with the present invention, each space in group 18 represents two states (except in one case wherein two states and the District of Columbia are represented) as a political subdivision. The other group of spaces 20 contain printed indicia thereon representing game instructions which can affect the play of the game, as is evident from the drawing. One of the spaces 22 of the group of spaces 20 is a start space located in one of the corners of the board.

The game includes a plurality of play pieces 24 which are distinctive from each other, either in shape or in color, for use by the players in moving about the periphery of the game board. At the beginning of the game, each player selects the piece he wishes to represent him and he places it on start space 22.

Movement of the play pieces along the play path defined by spaces 16 is controlled by chance means such as, for example, a pair of conventional dice 26. In the play of the game, each player moves in turn and advances his play piece the number of spaces represented by the dice he has thrown.

Among the second group of spaces 20 are one or more "criticism and endorsement" spaces 28. When a player lands on one of these spaces he selects an instruction card from a stack 30 of instruction cards (see FIG.

5) each of which contains an instruction for the player which may affect movement of his play piece during the play of the game. For example, the card illustrated at the top of stack 30 in FIG. 5 advises the player that his television declarations have made a certain group of intellectual organizers unhappy and that his party campaign planners think it would be beneficial for him to stop campaigning and perform a series of lectures to these dissatisfied organizations. The card instructs the player to draw one die and determine how many turns he will lose while he stays in the criticism and endorsment space while performing those lectures. Other cards have other instructions which entitle the player to advance or retreat a certain number of spaces or to a particular political subdivision all as a result of some causality related to a political campaign. After a player has selected his card and followed the instructions it is placed at the bottom of the stack of cards.

In accordance with an important feature of the present invention, a plurality of sets of campaign promises are provided which the players may use during the course of the game as they land on respective political subdivisions. These campaign promise markers are illustrated above the chart shown in FIG. 4. Each marker has a different illustration thereon to represent a particular campaign promise to develop a particular industry. For example, petroleum and gas has a symbol representative of an oil well. Metals and mining has a symbol representative of a bar of gold. As seen in FIG. 4, each marker has a different illustration thereon representative of the particular promise and, preferably, each marker for each campaign promise has a different configuration.

A set of campaign promise markers is provided for each of the players in the game. Preferably, each marker in each set is colored to correspond to the colors of the play pieces 24 selected by the player. Each set of markers contains a plurality of markers representative of each of the different campaign promises. The chart of FIG. 4 shows, for two players, the maximum number of campaign promises of each type in each set. In accordance with the rules of the game, as described hereinafter, the number of campaign promises which can be used by each player during the course of the game varies in accordance with the number of players in the game. The distribution of campaign promises as shown in the chart in FIG. 4 is selected such that there are always approximately one hundred campaign promises available to be made during the course of the game, regardless of the number of players. This arrangement has been selected so as to maintain interest of the game and require the players to apply good judgment to properly use their campaign promises in order to get the best benefit out of them as they pass through the particular political subdivisions. In addition, as the game is typically played within a given time period, the number is selected such that given the number of players, the players will not run out of campaign promises before the elapse of the selected time period.

Accompanying the chart 32 for the distribution of campaign promises according to the game is a chart 34 which provides indicia representing the scoring value of the different campaign promises. This chart includes a plurality of columns 36 and intersecting rows 38. The columns 36 represent the different political campaign promises, while rows 38 represent the different political subdivisions depicted on play board 12. The intersection of the rows and columns provides spaces 40 on which are printed indicia representative of the scoring value of the campaign promises.

For convenience in determining the scoring values of a particular subdivision spaces 16, along each side of the game board, are colored in some portion thereof, such as for example, the upper edge portion 42, with the spaces on each side having a different color. In addition, each space on each side is numbered from 1 to 6 (or 7 on the right side of the board as seen in FIG. 1). Thus when a player lands, for example, on the political subdivision representing New York and New Jersey, he knows that he landed on the pink space numbered 4. The scoring value chart is divided in a similar manner, with the numbers to the left of each political subdivision colored to correspond to the colors on the board 12, so that the player need only look at the pink row for number 4, and find the political subdivision of New York and New Jersey. Then, if the player elects to make a particular campaign promise, such as for example relating to farms and cattle, he can then determine the value of that campaign promise as a percentage of the total vote of the state. In the illustrative embodiment, the value of the farms and cattle campaign promise is between a maximum of 20 percent and a minimum of 10 percent of the vote. Under the rules of the game, as described hereinafter, the first player to arrive on a particular subdivision and make a particular campaign promise is awarded the maximum value of that campaign promise, in this case 20 percent.

In accordance with the present invention, the scoring values on the campaign promises chart permits only five or six campaign promises to be made for each state. The other campaign promises in a particular political subdivision have no value. The distribution of the campaign promises is selected to conform substantially to the interests of the particular states involved, and to the value of a particular subject to that state. For example, in the yellow zone, which contains primarily farming states, agricultural campaign promises are highly valued. On the other hand in the Northeast, only one of the political subdivisions achieves any percentage of the vote with an agricultural campaign promise. Thus, the distribution of scoring values among the political subdivisions not only adds play value to the game, but also serves an educational function in showing the players what issues are of particular relevance in particular areas of the country.

In accordance with an aspect of the invention the maximum value of campaign promises for each political subdivision is 150, and the minimum is between 85 and 95. In the play of the game, there can be no more than a total of 100 percent of the vote awarded in each state, but the range of values for the campaign promises allows the players to dispute particular political subdivisions during the play of the game by varying the percentage of the vote awarded to different players during the course of the game in a particular political subdivision, as described hereinafter in accordance with the rules of the game.

Finally, a score sheet 40 is provided for keeping track of the award and variation of the vote percentage in each political subdivision during the course of the game. The scorecard is somewhat similar to the scoring value chart in that it contains 11 columns representing the respective campaign promises, and 25 rows representing the political subdivisions on the play board. The intersections between the rows and columns provide spaces at which scoring information is recorded, as described hereinafter.

RULES OF PLAY

The political campaign game of the present invention may be played by any number of players, between 2 and 6. The object of the game is for one of the players to be elected President of the United States by accumulating the maximum number of electoral college votes by means of making campaign promises in the various political subdivisions or states visited during the campaign.

Initially, each player selects a play piece 24 of a particular color with which he will be identified with during the entire campaign. The colored pieces are moved along spaces 16 in accordance with the numbers rolled on the chance means or dice 26. Play begins with the player who throws the highest number on the dice and proceeds from player to player in a clockwise direction.

Before beginning play a referee is appointed by mutual agreement of the players; which referee may be one of the players themselves. The referee is responsible for marking the scoreboard 40 and interpreting the rules of the game in case of dispute. The referee by himself, or all of the players in agreement, determine the amount of time the game will be played before play is started. At the end of that fixed time period the campaign is declared closed and the election takes place, i.e., the results are tabulated. Typically, the game is played for a period of two to three hours.

As described above, each player is provided with a complete set of campaign promise markers 37 which represents his resources for the political campaign. The number of campaign promises of each type given to a particular player varies with the number of players in the game, as shown on the distribution chart of FIG. 4.

The value of each campaign promise in each state is shown on the scoring value chart of FIG. 2, which chart shows the campaign promises that can be used in each particular political subdivision. The scoring value chart also shows the number of electoral votes assigned to each political subdivision in the column marked "total vote." As previously mentioned, although the game board is divided into twenty-five spaces 18 of the first group, representing political subdivisions, it is contemplated that more or less spaces can be provided in the game. In particular, it is contemplated that each individual state can be represented by a separate space if desired. This would necessitate modifying the scoreboard and scoring value chart accordingly.

After the campaign promise markers are distributed in accordance with the chart of FIG. 4, each player, starting with the first player, rolls the dice and moves his marker 24 in a clockwise direction around the board starting from the start square 22. If a player's marker falls on any of the spaces 16 other than a political subdivision, he carries out the instructions marked thereon.

If the player's marker falls on any one of the squares representing a pair of states, he may, if he wishes, make a campaign promise of any development activity valid for those states, as determined by the chart 34 of FIG. 2, by placing the appropriate campaign marker from his set on the area designated at the top of each space. The referee will then note this campaign promise on the scoreboard 40 of FIG. 3 in the manner described hereinafter.

The dice then pass to the next player who repeats the same procedure. A player may elect not to make any campaign promise in any state which he visits, but he must remain in that state until his next turn.

If a player's marker falls on any one of the squares marked "criticism and endorsement" the player takes a card from the top of the stack of cards 30, which are located face down on the board in the square 42 marked for that purpose. After reading the instructions out loud to the other players, the player picking the "criticism and endorsement" card carries out the instructions thereon. Once the card is used it is placed face down at the bottom of the pile for reuse later in the game.

Play continues in this manner until the time selected for the play of the game terminates. The election then takes place.

SCORING

The campaign promise markers are intended to represent promises for developing various fields of activity in the state such as: industry, agriculture, energy, health, transportation, etc.; with each promise represented by appropriate symbols on the campaign promise markers. Each campaign promise is allocated two values, a maximum and a minimum percentage of the vote, for each political subdivision for which they are valid. These values represent the percentage of the electorate's vote which the player will receive in that pair of states in which the promise is made.

No player is permitted to use the same campaign promise more than once in the same political subdivision and the players may not make a campaign promise which has already been made in that subdivision by another player. Only one campaign promise can be made in each visit to a political subdivision.

The maximum number for a campaign promise represents the maximum percentage of the electorate's vote which the player can possibly receive in that pair of states for that particular campaign promise, provided that the total of all the campaign promises made in that pair of states does not exceed 100 percent.

The minimum number for a campaign promise represents the minimum percentage of the electorate which a player is assured of winning in that political subdivision even though later visits by later players result in other campaign promises being made in those same states.

The player who makes the first campaign promise in any political subdivision receives the maximum value represented by that promise for the political subdivision on the scoring value chart of FIG. 2. Following players who visit that political subdivision will also receive the maximum value for campaign promises which they make until the total value of all of the promises made reaches 100%. When the total value of the vote surpasses 100%, the player making the campaign promise that causes the vote to surpass 100% reduces the values of the previous players' promises to their mimimum values, in reverse order of their arrival in the political subdivision (i.e., going from last to first) until the total reduction achieved is sufficient to permit him to make the further promise at its minimum value while keeping the total not greater than 100%. In such situations it is possible that as a result of such vote reductions the total vote may be less than 100%.

Only maximum and minimum values for campaign promises can be kept for scoring purposes. No intermediate values are permitted in the game.

When the campaign promise of the first player has been reduced to its minimum by following players or if there are no more campaign promises available for the particular political subdivision, the campaign in that political subdivision is closed and no further promises can be made for that political subdivision.

The referee keeps a record on the scoreboard 40, which is provided for that purpose, of each player's campaign promises made in each pair of states, in the order of precedence in which the promises are made and the percentage of the electorate awarded to each candidate in each pair of states.

The following is an example of scoring by the referee during the course of the game for a particular political subdivision. Say, for example, on his first turn the first player R arrives at the political subdivision representing Nevada and California, i.e., yellow zone no. 2, and he elects to make a campaign relating to the development of agriculture. Player R places his campaign promise marker representing agriculture on the upper section of the space 18 for that political subdivision. The referee marks the scorecard, as seen in FIG. 3, by placing a diagonal line 50 on the scorecard in the space at the intersection of the agriculture column and the Nevada-California row, and in the upper portion of the divided space places the player's initial R and the number 1, to represent that player R arrived at Nevada and California first. The referee then places the number 30 as the maximum percentage of the vote according to the chart from FIG. 2 in the lower portion of the space at the intersection of the agriculture column and the Nevada-California row. Later on in the game player P arrives at Nevada-California and makes a campaign promise relating to the development of the manufacturing industry. Again the referee places a slash line through the scoreboard, and in the upper left hand corner of the space places the initial P and the number 2 indicating that player P arrived at Nevada-California second. In the lower portion of the space the referee places the numeral 25 to indicate the maximum percentage of the vote gained by player P. Subsequently, the player T arrives at Nevada-California and the referee places the slash line in the appropriate space and the initials T-3 to represent that the player T arrived third at that political subdivision. He also places the number 20 in the lower right hand portion of the box, to indicate the maximum vote attained by player T as a result of making a promise concerning the development of petroleum and gas.

Suppose now that player P again arrives at Nevada-California and makes a campaign promise relating to the development of mining and metals. The referee marks the scorecard P-4 and 25 in the lower right hand corner of the box. At this point 100% of the vote for the political subdivision of Nevada-California is accounted for. Hereafter, when any further player arrives at this political subdivision, the only way for him to attain a percentage of the vote is to make an additional campaign promise and then reduce a portion of the vote of the prior players in reverse order. Thus, for example, suppose that now player R returns to Nevada-California. He may make a political promise relating to the development of tourism. The referee places the slash line in the scoreboard and the initials R-5 in the upper left hand corner. Since 100% is already accounted for he must reduce the percentage of the vote attained by the other players who previously arrived at this political subdivision, in an amount sufficient to enable R to obtain 20% of the vote under the tourism promise. The referee notes that the last player to arrive at this political subdivision was player P, who made a promise under mining and metals. The referee reduces the mining and metals vote of player P from 25 to 15. This frees 10% of the vote for that political subdivision. However, the referee must give player R 20 percent of the vote (the minimum value of the tourism promise) and thus must obtain another 10% of the vote. He goes to the third player to arrive at this political subdivision, player T, and reduces player T's percentage of the vote from 20% to 10%, as indicated in FIG. 3. He can now award player R 20% of the vote under the tourism campaign promise. As the vote now stands player R leads in the political subdivision of Nevada-California by a vote of 50% to 40% for player P and 10% for player T. However, there is still the possibility for player P to win this political subdivision.

If player P arrives at Nevada-California again before the end of the game he may still make a political campaign promise with respect to the development of farms and cattle (assuming he has within his possession an appropriate campaign promise marker). If he does so, the referee places his initial and the numeral 6 in the upper left hand corner of the appropriate box and reduces prior players' votes in order to enable him to award 10% of the vote to player P. Thus, the referee first looks at the score for the fifth player to arrive at this political subdivision, player R, under tourism, and finds that player R already has a minimum value for that campaign promise. He then goes to the fourth player P, and finds that he has a minimum value, although since player P is the player who seeks to obtain votes, the referee would not reduce that player's own prior scores. The third player, player T, has already had his percentage of the vote reduced to a minimum under petroleum and gas. The second player, player P, is skipped again since it is player P who is seeking to add additional votes. Finally, the referee arrives at the first player to land on the political subdivision of Nevada-California, player R. The referee can reduce the maximum value of 30 previously given to player R to 20, as noted in FIG. 3, and then award a value of 10% of the vote to player P. At this point all of the campaign promises for this political subdivision have been used up by the players, and no further promises can be made. At the end of the game, when the vote is tallied, it is found that player R has 40% of the vote and player P has 50% of the vote while player T has 10%. Thus, the winner is player P, and he attains the 49 electoral votes of this political subdivision.

Scoring in the other political subdivisions is carried out in the identical manner.

Upon completion of the game, the count of the electoral votes for each candidate is made by the referee and tabulated. The winner of the majority of electoral votes is, of course, president.

In the event that the campaign in any political subdivision results in a tie between two or more players, the player involved in the tie who made the first campaign promise at that political subdivision will be declared the winner thereof.

Additionally, players are not permitted to trade campaign promises for percentages of the electorate during the course of the game and, preferably, interim counting of the votes during the campaign is not permitted, although the players may be permitted to determine the percentage of the vote for a particular political subdivision to aid them in determining their strategy for making campaign promises.

Accordingly, a relatively simple political campaign game is provided which permits the players to make political campaign promises of varying values throughout the course of the game in order to vary the percentage of the vote which they and their competitors hold in a particular political subdivision so that the outcome of the game remains in doubt throughout the game until the time for the play of the game has expired. The game closely simulates real elections since the position of any player during the game fluctuates as promises are made and the outcome remains in doubt until the end of the game as with any real political election. Still further, the order of visiting a particular political subdivision has only a partial affect on the outcome of the game and thus is not absolutely critical to the outcome. The effect of the order of visiting the state relates to the extent of determining the regressive order by which values of campaign promises can vary from a maximum to a minimum. Simply being the first to arrive at a political subdivision is not a guarantee that that political subdivision has been won. Even a last arrival at a political subdivision can be the winner thereof, as discussed above. Morever, the game is educational since the campaign promises involve fields of activity predominant in each political subdivision, and will familiarize the players with what is more important in each particular area of the country.

The game is formulated with a specific distribution of campaign promises, numbers of promises available for each state, and value of promises in the particular states or political subdivisions to eliminate luck as a major factor in playing the game. The game is premised on the making of proper decisions and campaign promises in particular types of political subdivisions in order to get the best out of each promise. Thus, the player is trained when to use or not use particular promises in particular areas. The game requires players to make conscious decisions at almost every movement of his play piece in determining whether or not campaign promises should or should not be made in a particular state and if so which one should be made. Also, the scoring for the game is quite simple for one player of even a relatively young age to handle.

Although an illustrative embodiment of the present invention here with reference to the accompanying drawings, it is to be understood that the invention is not limited to that precise embodiment, and that various changes and modifications may be effected therein by one skilled in the art without departing from the scope or spirit of this invention.

What is claimed:

1. A political campaign game comprising:

a polygonal game board having a plurality of sides and defining a play surface;

indicia on said play surface defining first and second groups of spaces along the sides of the board providing a play path for the players; said first group of spaces containing indicia idicative of distinct political subdivisions and said second group of spaces containing indicia providing game instructions; one of said spaces in said second group providing a starting space from which play is commenced;

a plurality of distinct play pieces to be selected and used by each player and moved along said spaces in said play path;

chance means for randomly determining the number of spaces a play piece may be moved along said play path during a player's turn;

a plurality of campaign promise markers including a plurality of sets of markers, one set for each player of the game; the campaign markers in each of said sets including a plurality of subsets of markers; each of said subsets within a set of campaign markers bearing different indicia representative of a different kind of campaign promise in a political campaign and containing a plurality of individual markers bearing the distinctive indicia of the subset; and a campaign promise scoring value chart including a plurality of columns, said chart including indicia associated with each of said columns respectively representing each of said different campaign promises whereby there is one column for each such kind of promise; and a plurality of rows extending transversely of said columns respectively representing said political subdivisions; the intersection of said columns and rows on the chart defining spaces containing the maximum and minimum percentage of the vote values for at least some of said campaign promises in each of said political subdivisions.

2. A political campaign game as defined in claim 1 including a scoreboard for recording the arrival of a player's play piece at one of said political subdivision spaces and the percentage of vote gained by each player for each of said campaign promises.

3. A political campaign game as defined in claim 2 wherein said scoreboard includes a plurality of columns respectively including indicia associated with each of said columns of the scoreboard representing each of said different campaign promises whereby there is one column for each such kind of promise and a plurality of rows extending transversely of said columns respectively representing said political subdivisions; the intersections of said columns and rows defining spaces in which said percentage of vote may be recorded.

4. A political campaign game as defined in claim 3 wherein the spaces in said first group are subdivided by distinguishable indicia into a plurality of political subdivision zones with each space in each zone being identified by a different indicia; said rows on said scoring value chart and said scoreboard being subdivided into zones corresponding to the political subdivision zones on the playboard by distinguishable indicia corresponding to the distinguishable indicia on the playboard, with each row in each zone also being identified by a different indicia corresponding to the different indicia of the political subdivision spaces in the zones on the playboard.

5. A political campaign game as defined in claim 4 wherein said distinguishable indicia on the play board are different colors printed in at least a portion of the spaces in each zone.

6. A political campaign game as defined in claim 5 wherein said different indicia on the play board are numerals.

7. A political campaign game as defined in claim 4 wherein the number of said campaign promise markers is varied according to a predetermined pattern depending upon the number of players in the game.

8. A political campaign game as defined in claim 7 including a set of criticism and endorsement cards, each of said cards having indicia thereon comprising instructions for movement of said play pieces.

9. A political campaign game as defined in claim 8 wherein said criticism and indorsement cards include at least some cards containing instructions concerning the marking of campaign promises.

10. A political campaign game as defined in claim 8 wherein said second group of spaces includes spaces containing instructions instructing the player to select a criticism and endorsement card when the players play piece arrives at such a space.

11. A political campaign game as defined in claim 10 wherein said political subdivisions represented by each space in said first group comprise at least two states of the United States.

12. A political campaign game as defined in claim 11 wherein said board contains in each of said spaces of the first group indicia representative of the number of electoral votes assigned to each such political subdivision.

13. A political campaign game as defined in claim 10 wherein there are eleven different campaign promises represented by said markers.

14. A political campaign game as defined in claim 13 wherein said chance means are a pair of dice.

* * * * *